US009072337B2

(12) United States Patent
Meschter et al.

(10) Patent No.: US 9,072,337 B2
(45) Date of Patent: Jul. 7, 2015

(54) ARTICLE OF FOOTWEAR INCORPORATING AN IMPACT ABSORBER AND HAVING AN UPPER DECOUPLED FROM ITS SOLE IN A MIDFOOT REGION

(75) Inventors: James C Meschter, Portland, OR (US); Matthew A Nurse, Lake Oswego, OR (US); Benjamin A Shaffer, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 1261 days.

(21) Appl. No.: 12/246,149

(22) Filed: Oct. 6, 2008

(65) Prior Publication Data

US 2010/0083535 A1 Apr. 8, 2010

(51) Int. Cl.

| | |
|---|---|
| ***A43B 3/26*** | (2006.01) |
| ***A43B 7/24*** | (2006.01) |
| ***A43B 13/28*** | (2006.01) |
| ***A43B 23/02*** | (2006.01) |
| ***A43B 7/14*** | (2006.01) |
| ***A43B 13/18*** | (2006.01) |

(52) U.S. Cl.

CPC ..... *A43B 7/1495* (2013.01); *A43B 3/26* (2013.01); *A43B 7/24* (2013.01); *A43B 13/28* (2013.01); *A43B 23/0245* (2013.01); *A43B 13/187* (2013.01); *A43B 23/0235* (2013.01)

(58) Field of Classification Search

CPC ..... A43B 3/0036; A43B 3/26; A43B 7/24; A43B 13/28; A43B 23/0245

USPC ..... 36/45, 55, 88, 93, 97, 102, 107, 68, 69, 36/71, 72 R, 145, 148, 149

See application file for complete search history.

(56) References Cited

U.S. PATENT DOCUMENTS

| | | | |
|---|---|---|---|
| 337,146 | A | 3/1886 | Gluecksmann |
| 2,048,683 | A | 7/1936 | Brockman |
| 2,299,009 | A | 10/1942 | Denk |
| 2,814,132 | A | 11/1957 | Montoscuro |
| 3,377,723 | A | 4/1968 | England |

(Continued)

FOREIGN PATENT DOCUMENTS

| | | | |
|---|---|---|---|
| CN | 1149241 | A | 5/1997 |
| CN | 1386052 | A | 12/2002 |

(Continued)

OTHER PUBLICATIONS

Invitation to Pay Additional Fees mailed Apr. 12, 2010, with Annex containing results of International Search from PCT Application No. PCT/US2009/059189.

(Continued)

*Primary Examiner* — Khoa Huynh
*Assistant Examiner* — Sharon M Prange
(74) *Attorney, Agent, or Firm* — Plumsea Law Group, LLC

(57) ABSTRACT

An article of footwear includes an upper, a sole attached to the upper, and an impact absorber attached to the upper at least along a midfoot region of the upper and capable of absorbing a portion of a lateral impact when the impact absorber is moved into contact with a top surface of the sole. The impact absorber is be integrally formed with the sole and has a width that varies along a length of the impact absorber. The width of the impact absorber decreases in a forefoot region and a heel region. The upper rolls to contact the top surface of the sole upon lateral impact. The sole and the upper may be attached asymmetrically.

28 Claims, 25 Drawing Sheets

(56) References Cited

U.S. PATENT DOCUMENTS

| | | | | | |
|---|---|---|---|---|---|
| 3,404,468 | A | | 10/1968 | Rosen | |
| 3,586,003 | A | * | 6/1971 | Baker | 36/145 |
| 3,739,500 | A | | 6/1973 | Cox | |
| 3,822,490 | A | | 7/1974 | Murawski | |
| 4,449,307 | A | | 5/1984 | Stubblefield | |
| 4,492,046 | A | | 1/1985 | Kosova | |
| 4,546,556 | A | | 10/1985 | Stubblefield | |
| 4,550,510 | A | | 11/1985 | Stubblefield | |
| 4,794,706 | A | * | 1/1989 | Puckhaber et al. | 36/91 |
| 4,827,631 | A | | 5/1989 | Thornton | |
| 4,852,275 | A | | 8/1989 | Bianchini et al. | |
| 4,858,341 | A | | 8/1989 | Rosen | |
| 5,060,402 | A | * | 10/1991 | Rosen | 36/97 |
| 5,241,762 | A | * | 9/1993 | Rosen | 36/97 |
| 5,435,079 | A | | 7/1995 | Gallegos | |
| 5,678,329 | A | | 10/1997 | Griffin et al. | |
| 5,794,359 | A | | 8/1998 | Jenkins et al. | |
| 5,806,209 | A | | 9/1998 | Crowley et al. | |
| 6,115,945 | A | | 9/2000 | Ellis, III | |
| 6,145,867 | A | | 11/2000 | Bourdeau | |
| 6,438,873 | B1 | * | 8/2002 | Gebhard et al. | 36/114 |
| 6,625,906 | B2 | | 9/2003 | Mayer et al. | |
| 6,948,262 | B2 | * | 9/2005 | Kerrigan | 36/27 |
| 7,080,467 | B2 | | 7/2006 | Marvin et al. | |
| 7,159,339 | B2 | | 1/2007 | Mathieu et al. | |
| 7,395,616 | B2 | | 7/2008 | Fallon | |
| 2002/0026730 | A1 | | 3/2002 | Whatley | |
| 2002/0144430 | A1 | | 10/2002 | Schmid | |
| 2003/0046830 | A1 | | 3/2003 | Ellis, III | |
| 2004/0168350 | A1 | * | 9/2004 | Mathieu et al. | 36/25 R |
| 2005/0120592 | A1 | | 6/2005 | Rodriguez | |
| 2005/0166422 | A1 | | 8/2005 | Schaeffer et al. | |
| 2006/0162191 | A1 | | 7/2006 | Mason | |
| 2007/0017123 | A1 | | 1/2007 | Scofield et al. | |
| 2007/0084081 | A1 | * | 4/2007 | Fallon | 36/28 |
| 2009/0260259 | A1 | * | 10/2009 | Berend | 36/88 |

FOREIGN PATENT DOCUMENTS

| | | | |
|---|---|---|---|
| CN | 101014260 | A | 8/2007 |
| CN | 101146462 | A | 3/2008 |
| CN | 101287388 | | 10/2008 |
| DE | 19713013 | | 10/1997 |
| EP | 0174878 | | 3/1986 |
| FR | 1244802 | | 10/1960 |
| FR | 2462117 | | 2/1981 |
| FR | 2914156 | | 10/2008 |

OTHER PUBLICATIONS

International Search Report and Written Opinion mailed Jun. 23, 2010 in PCT Application No. PCT/US2009/059189.

International Preliminary Report on Patentability (including Written Opinion of the ISA) mailed Apr. 21, 2011 in International Application No. PCT/US2009/059189.

Second Office Action issued Sep. 22, 2014 in Chinese Patent Application No. 200980148856.0, and English translation thereof.

Response to First Office Action issued Mar. 13, 2014 in Chinese Patent Application No. 200980148856.0, filed Jul. 28, 2014, and English translation thereof.

Response to Second Office Action filed Dec. 8, 2014 in Chinese Patent Application No. 200980148856.0, and English translation thereof.

Office Action issued Mar. 13, 2014 in Chinese Patent Application No. 2009801488560, and English translation thereof.

Office Action issued Mar. 3, 2015 in Chinese Patent Application No. 201310529749.0, with English translation thereof.

Office Action issued Mar. 26, 2015 in Chinese Patent Application No. 201310529410.0, with English translation thereof.

Office Action issued Apr. 21, 2015 in Chinese Patent Application No. 200980148856.0, and English translation thereof.

Office Action issued Apr. 14, 2015 in Chinese Patent Application No. 201310529408.3, and English translation thereof.

* cited by examiner

ARTICLE OF FOOTWEAR INCORPORATING AN IMPACT ABSORBER AND HAVING AN UPPER DECOUPLED FROM ITS SOLE IN A MIDFOOT REGION

BACKGROUND

Conventional articles of athletic footwear include two primary elements, an upper and a sole structure. The upper provides a covering for the foot that comfortably receives and securely positions the foot with respect to the sole structure. The sole structure is secured to a lower portion of the upper and is generally positioned between the foot and the ground. In addition to attenuating ground reaction forces, the sole structure may provide traction, control foot motions (e.g., by resisting pronation), and impart stability, for example. Accordingly, the upper and the sole structure operate cooperatively to provide a comfortable structure that is suited for a wide variety of athletic activities.

The sole structure generally incorporates multiple layers that are conventionally referred to as an sockliner, a midsole, and an outsole. The sockliner is a thin, compressible member located within the upper and adjacent to a plantar (i.e., lower) surface of the foot to enhance footwear comfort. The midsole is conventionally secured to a lower surface of the upper and forms a middle layer of the sole structure that is primarily responsible for attenuating ground reaction forces. The outsole forms the ground-contacting element of the footwear and is usually fashioned from a durable, wear-resistant material that includes texturing to improve traction.

The conventional midsole is primarily formed from a resilient, polymer foam material, such as polyurethane or ethylvinylacetate, that extends throughout the length of the footwear. The properties of the polymer foam material in the midsole are primarily dependent upon factors that include the dimensional configuration of the midsole and the specific characteristics of the material selected for the polymer foam, including the density of the polymer foam material. By varying these factors throughout the midsole, the relative stiffness and degree of ground reaction force attenuation may be altered to meet the specific demands of the wearer or of the activity for which the footwear is intended to be used.

In addition to polymer foam materials, conventional midsoles may include, for example, one or more fluid-filled chambers. In general, the fluid-filled chambers are formed from an elastomeric polymer material that is sealed and pressurized. The chambers are then encapsulated in the polymer foam of the midsole such that the combination of the chamber and the encapsulating polymer foam functions as the midsole of the sole structure. In some configurations, textile or foam tensile members may be located within the chamber or reinforcing structures may be bonded to an exterior or interior of the chamber to impart shape to the chamber.

Articles of athletic footwear are designed with a particular purpose in mind. Some articles of athletic footwear are designed to withstand jarring impact. Others are designed to withstand lateral impact. Some are designed to enhance stability. Others are designed to provide enhanced cushioning. The purpose for which a shoe will be used informs the design choices made by the designers.

Turning to FIGS. 3 and 4, prior art articles of footwear are shown. FIG. 3 shows an article of footwear 300 that is typical of a running shoe. When a runner wants to make a turn, he or she will plant a foot, which often creates a lateral force on the shoe. The midsole of the shoe will absorb some of the impact, but after some impact has been absorbed, the lateral force of the foot within the shoe 300 causes the shoe 300 to tip, as can be seen in FIG. 3. In addition, the lateral force absorption is noticeably lacking when the shoe 300 is examined on a slope, such as is shown in FIG. 4. In some cases, particularly in trail running, the terrain is not flat, instead including many irregular surface patterns. When the runner plants a foot on such irregular terrain, the midsole can only deform slightly and does not absorb sufficient lateral forces. This creates strain on the runner's foot and ankle.

SUMMARY

In one aspect of the invention, an article of footwear can include an upper, a sole attached to the upper, and an impact absorber attached to the upper at least along a midfoot region of the upper and capable of absorbing a portion of a lateral impact when the impact absorber is moved into contact with a top surface of the sole. The impact absorber may be integrally formed with the sole. The impact absorber may have a width that varies along a length of the impact absorber. The width of the impact absorber may decrease in a forefoot region and a heel region. The upper may be configured to roll to contact the top surface of the sole upon lateral impact. In addition, the sole and the upper may be attached asymmetrically.

For certain articles of footwear, a first impact absorber or first impact absorber portion may be attached along a medial side of the upper and a second impact absorber or second impact absorber portion may be attached along a lateral side of the upper. In such cases, the first impact absorber may differ in size and shape from the second impact absorber.

In another aspect of the invention, an article of footwear includes a sole having a top surface and configured to support feet having varying widths, and an upper made of a flexible material capable of conforming to feet of varying widths, the upper attached to the top surface of the sole in a manner allowing a free area of the upper to be positioned in varying angles from the top surface of the sole. The article of footwear may also include an impact absorber attached to the free area of the upper. The free area may be at least in a midfoot region of the upper. The free area may have a width and a length, the width of the free area varying along its length. The width of the free area may decrease at its ends. The upper may be configured to roll to contact the top surface of the sole upon lateral impact. The upper and the sole may be attached asymmetrically.

In certain cases, the upper may also includes a first free area on a lateral side and a second free area on a medial side. The size and shape of the first free area may differ from the size and shape of the second free area.

In another aspect of the invention, the article of footwear includes a sole having a top portion and a bottom portion, at least a portion of the periphery of each of the top and bottom portion being separate from the other of the top and bottom portion in at least a midfoot region, an upper having an outer surface, and wherein the top portion of the sole is attached to the outer surface of the upper, thereby allowing rotational freedom between the two portions of the sole in the peripheral location where the top and bottom portions are separated. The peripheries of the top and bottom portions of the sole may be continuous in at least part of a heel region and a forefoot region. The upper and top portion of the sole may be configured to roll to contact the bottom portion of the sole upon lateral impact. The separation of the top and bottom portions of the sole may define a recess and the width of the recess may vary along its length. The width of the recess may decrease at its ends.

In certain cases, the top and bottom portions of the sole are separate from one another on both a lateral side and a medial side of the sole. The separation of the top and bottom portions of the sole on each of the lateral side and the medial side may define a recess and the width of each recess may vary along its respective length. The medial and lateral recesses may differ from one another in size and shape.

In a further aspect of the invention, an article of footwear includes an upper coupled to a sole, the upper being coupled to the sole along a periphery of the sole in both a forefoot region and a heel region and at a position spaced from the periphery of the sole in a midfoot region. The upper may be coupled to the sole in a midfoot region in a position at least 10% of the width of the sole away from the periphery of the sole. The upper and sole may be coupled asymmetrically. An impact absorber may be attached to the upper.

In some cases, the upper may be coupled to the sole at a position spaced from the periphery of the sole in a midfoot region on each of a lateral and medial side of the sole. The upper may be coupled to the sole in a midfoot region in a position at least 10% of the width of the sole away from the periphery of the sole on each of the lateral and medial sides of the sole. The upper and sole may be coupled asymmetrically. A first impact absorber may be attached to the medial side of the upper and a second impact absorber may be attached to the lateral side of the upper.

The advantages and features of novelty characterizing various aspects of the invention are pointed out with particularity in the appended claims. To gain an improved understanding of the advantages and features of novelty, however, reference may be made to the following descriptive matter and accompanying drawings that describe and illustrate various embodiments and concepts related to the aspects of the invention.

DESCRIPTION OF THE DRAWINGS

The foregoing Summary, as well as the following Detailed Description, will be better understood when read in conjunction with the accompanying drawings.

DETAILED DESCRIPTION

The following discussion and accompanying figures disclose an article of footwear. Concepts related to the article of footwear are disclosed with reference to footwear having a configuration that is suitable for the sport of running. The sole structure is not limited solely to footwear designed for running, however, and may be utilized with a wide range of athletic footwear styles, including basketball shoes, tennis shoes, football shoes, cross-training shoes, walking shoes, soccer shoes, and hiking boots, for example. The sole structure may also be utilized with footwear styles that are generally considered to be non-athletic, including dress shoes, loafers, sandals, and boots. An individual skilled in the relevant art will appreciate, therefore, that the concepts disclosed herein apply to a wide variety of footwear styles, in addition to the specific style discussed in the following material and depicted in the accompanying figures.

Figure 1:
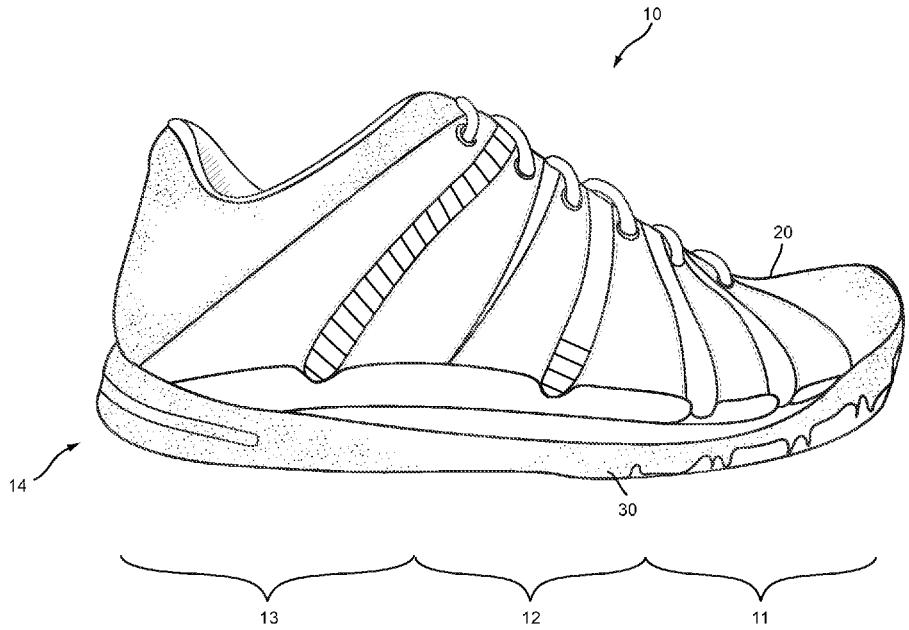
FIG. 1 is a lateral side elevational view of an article of footwear according to the present invention.
Figure 2:
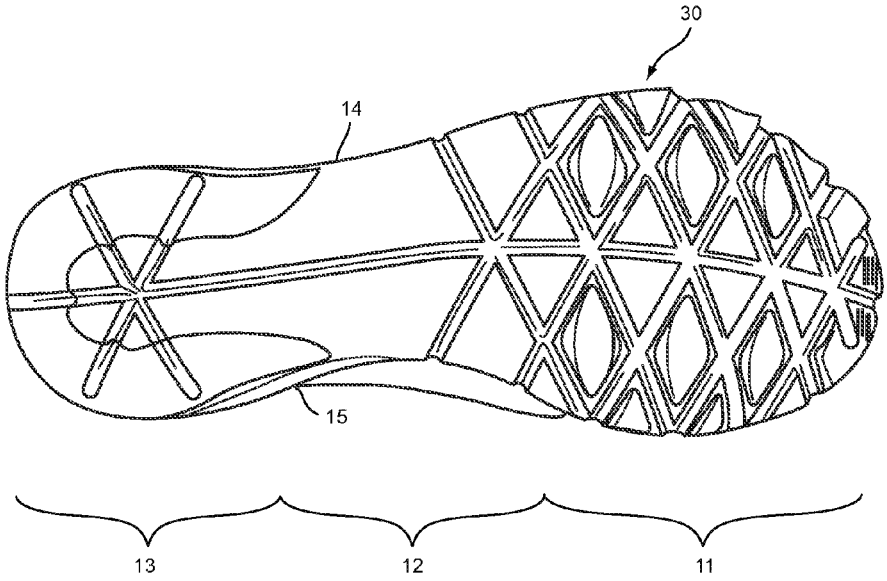
FIG. 2 is a bottom view of an article of footwear according to the invention.
Figure 3:
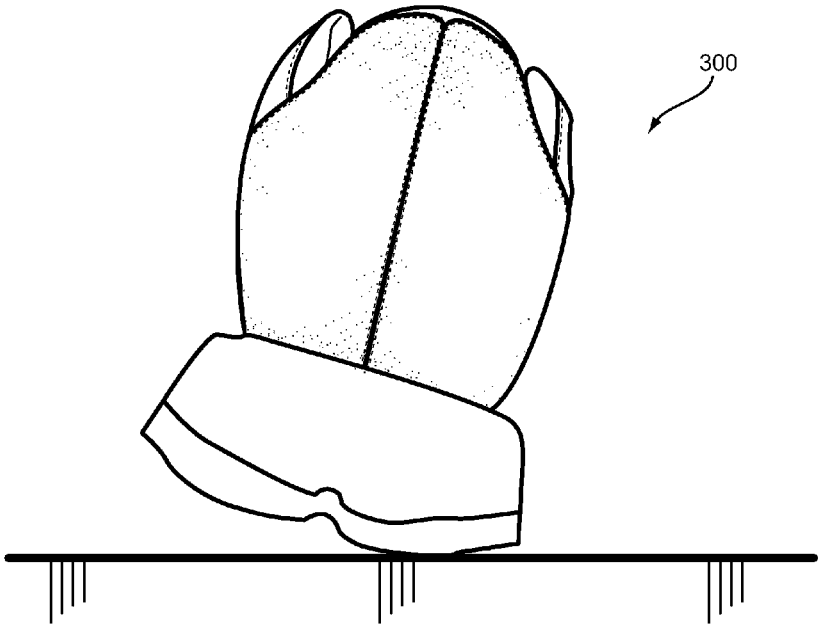
PRIOR ART FIG. 3
FIG. 3 is a rear elevational view of a prior art article of footwear.
Figure 4:
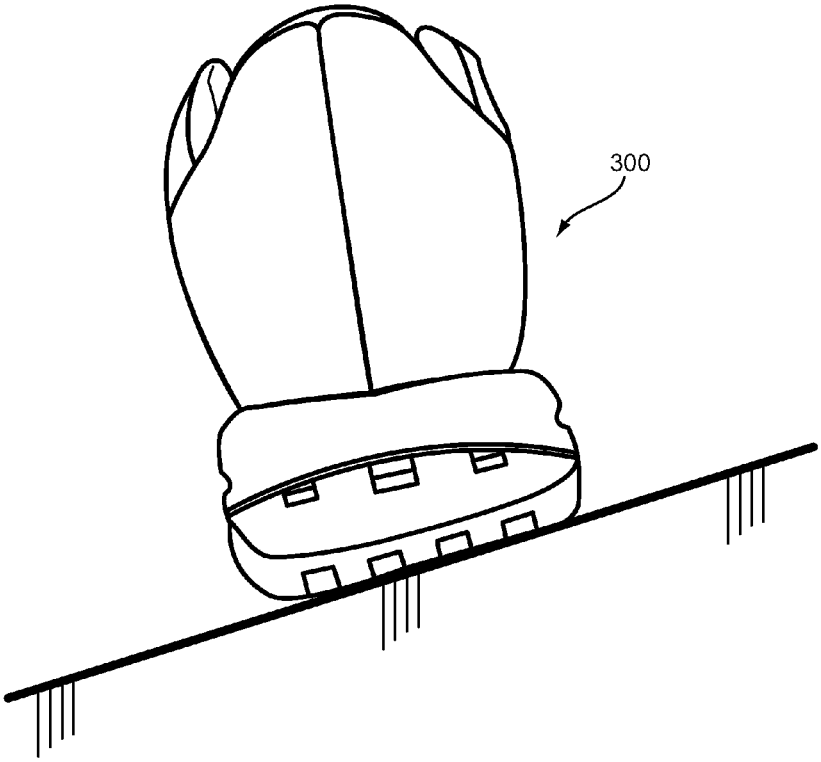
PRIOR ART FIG. 4
FIG. 4 is a rear elevational view of a prior art article of footwear positioned on a slope.

An article of footwear 10 is depicted in FIGS. 1 and 2 as including an upper 20 and a sole or sole structure 30. For reference purposes, footwear 10 may be divided into three general regions: a forefoot region 11, a midfoot region 12, and a heel region 13. Footwear 10 also includes a lateral side 14 and an opposite medial side 15. Forefoot region 11 generally includes portions of footwear 10 corresponding with the toes and the joints connecting the metatarsals with the phalanges. Midfoot region 12 generally includes portions of footwear 10 corresponding with the arch area of the foot, and heel region 13 corresponds with rear portions of the foot, including the calcaneus bone. Lateral side 14 and medial side 15 extend through each of regions 11-13 and correspond with opposite sides of footwear 10. Regions 11-13 and sides 14-15 are not intended to demarcate precise areas of footwear 10. Rather, regions 11-13 and sides 14-15 are intended to represent general areas of footwear 10 to aid in the following discussion. In addition to footwear 10, regions 11-13 and sides 14-15 may also be applied to upper 20, sole structure 30, and individual elements thereof. These elements of footwear 10 are common to all articles of footwear and are also present in the invention described herein.

Figure 5:
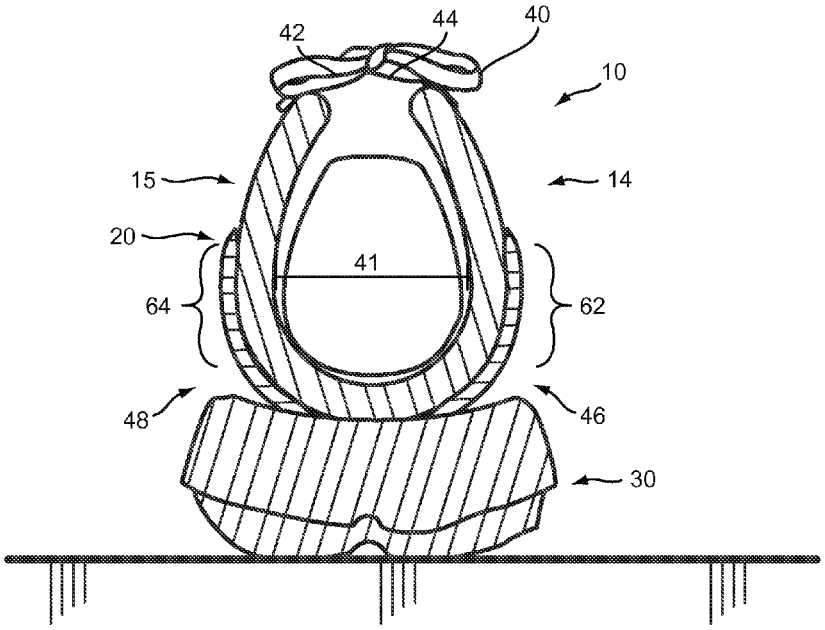
FIG. 5 is a cross sectional view of the first embodiment of the article of footwear taken along line 5-5 of FIG. 8 showing the article of footwear in use with a narrow foot.
Figure 6:
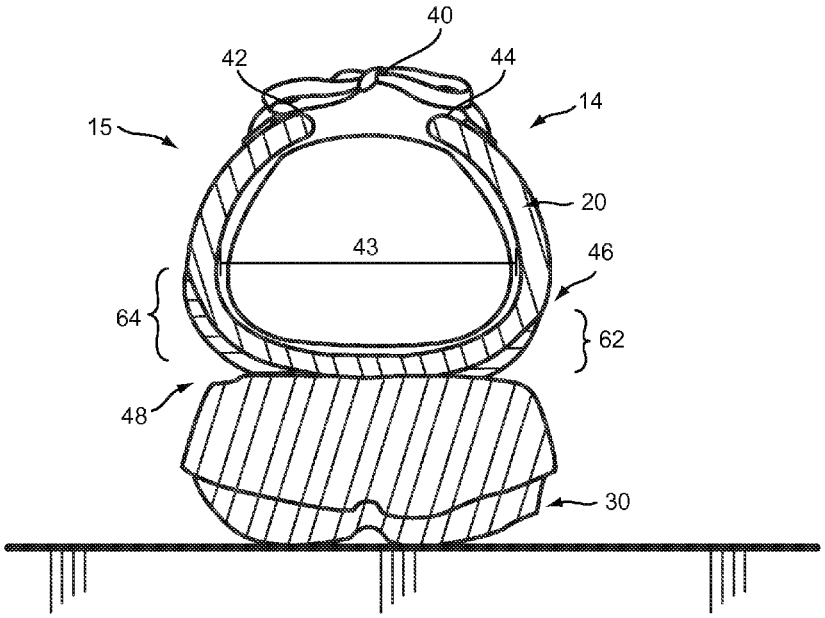
FIG. 6 is a cross sectional view of the first embodiment of the article of footwear taken along line 5-5 of FIG. 8 showing the article of footwear in use with a wide foot.
Figure 7:
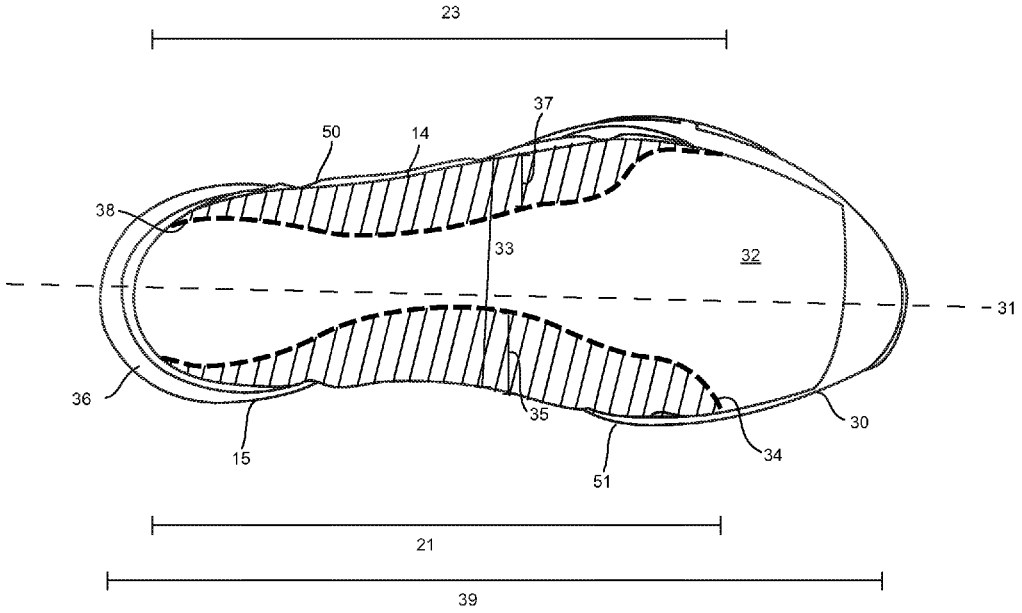
FIG. 7 is a top view of the sole of an article of footwear according to the invention showing the positioning of the upper relative to the sole.

Turning first to FIGS. 5-7, a first aspect of the invention is apparent. The upper 20 of the article of footwear 10 is attached or coupled to the sole 30 asymmetrically. FIG. 7 shows the top surface 32 of the sole 30 of the article of footwear 10. Axis 31 shows an approximate axis along the center of the top surface 32 of the sole 30. A first dashed line is one embodiment of a medial attachment boundary 34 that represents the position on the top surface 32 of the sole 30 where the upper 20 is joined to the sole 30 on the medial side 15 of the article of footwear 10. This medial attachment boundary 34 is located or spaced inward from the periphery or peripheral edge 36 of the sole 30. The medial attachment boundary 34 need not be a consistent distance from the periphery 36 of the sole 30. Instead, as shown in FIG. 7, the medial attachment boundary 34 approaches and then contacts the periphery 36 as the medial attachment boundary 34 nears the forefoot region 11 and heel region 13. The medial attachment boundary 34 is most clearly spaced from the periphery 36 in the midfoot region 12.

Similarly, a second dashed line is one embodiment of a lateral attachment boundary 38 that represents the position on the top surface 32 of the sole 30 where the upper 20 is joined to the sole 30 on the lateral side 14 of the shoe. This lateral attachment boundary 38 is located or spaced inward from the periphery or peripheral edge 36 of the sole 30. The lateral attachment boundary 38 need not be a consistent distance from the periphery 36 of the sole 30. Instead, as shown in FIG. 7, the lateral attachment boundary 38 approaches and then contacts the periphery 36 as the lateral attachment boundary 38 nears the forefoot region 11 and heel region 13. The lateral attachment boundary 38 is most clearly spaced from the periphery 36 in the midfoot region 12.

The upper 20 is attached or coupled to the sole 30 along the medial attachment boundary 38 on the medial side 15 of the sole 10, spaced from the periphery 36 of the sole 30 at least in a midfoot region 12. The upper 20 is attached or coupled to the sole 30 along the lateral attachment boundary 38 on the lateral side 14 of the sole 10, spaced from the periphery 36 of the sole 30 in at least a midfoot region 12. In the toe region 11 and the heel region 13, the upper 20 is attached or coupled to the sole 30 in an area that is along the periphery 36 of the sole 30. While the upper 20 may be attached to the sole 30 a small distance from the periphery 36 of the sole 30 in the toe region 11 and heel region 13, the upper is attached or coupled about at the periphery 36 and along the periphery 36.

The configuration shown in FIG. 7 is one possible configuration of the positioning and attachment and coupling of the upper 20 relative to the sole 30. In this configuration, the sole 30 has a width 33 at any specific point along the length 39 of the sole 30. The width or distance 35 represents the distance the medial attachment boundary 34 is positioned from the periphery 36 in a particular location along the length 21 of the sole 30 where the medial attachment boundary 34 is spaced from the periphery 36. The width or distance 37 represents the distance the lateral attachment boundary 38 is positioned from the periphery 36 in a particular location along the length 23 of the sole 30 where the lateral attachment boundary 38 is spaced from the periphery 36. It is desirable that for any embodiment of the footwear 10, that at least one of the width 35 and the width 37 be at least 10% of the width 33 of the sole 30 at some point along its respective length 21, 23. The attachment boundaries 34, 38 may be positioned on the sole 30 so that the upper 20 and sole 30 are coupled either symmetrically or asymmetrically about axis 31. As an upper limit, it is of course possible that width 37 and width 35 could be great enough that the attachment boundaries 34, 38 would be in substantially the same location on the sole 30. In such an instance, width 35 and width 37 might each have a value of about 50% the value of width 33. Alternatively, if desired, width 37 might have a value of about 60% of width 33 and width 35 might have a value of about 40% of width 33. Of course, the position of each attachment boundary 34, 38 may be tuned for a particular desired footwear application, and the values of width 37 and width 35 can vary widely, except that of course, the values of width 37 and width 35 added together can never exceed the value of width 33 at any given point along the length 39 of the sole 30. Finally, in some cases, it is possible that the value of width 35 or width 37 in a particular case would be close to zero and that the upper 20 would be attached on one of the medial side 15 or lateral side 14 at an area along the periphery 36 of the sole 30. It is also to be noted that the value of both width 35 and of width 37 vary along the length 39 of the sole 30 and their respective lengths 21, 23. The width 35 and the width 37 taper to a zero value in the areas of the forefoot region 11 and the heel region 13. As shown in FIG. 7, based on the contours of the sole 30 and the attachment boundaries 34, 38, the value of width 35 and width 37 may, but need not, gradually increase to a single high value.

The area on the top surface 32 of the sole 30 on the lateral side 14 between the lateral attachment boundary 38 and the peripheral edge 36 of the sole 30 can be described as the open lateral portion 50. The area on the top surface 32 of the sole 30 on the medial side 15 between the medial attachment boundary 34 and the peripheral edge 36 of the sole 30 can be described as the open medial portion 51. Either one of these portions 50, 51 can be described as an open portion of the sole.

One implication of this configuration of upper 20 being attached or coupled to the sole 30 along the attachment boundaries 34, 38 is that the same sole and upper configuration can be used to accommodate feet having varying widths. Referring again to FIGS. 5 and 6, it is shown how the footwear 10 would appear in cross section when used with feet of varying widths. FIGS. 5 and 6 are cross sections of a shoe with a foot inside taken along line 5-5 of FIG. 8. FIG. 5 shows how the footwear 10 will appear in cross-section with a foot having a narrow width 41. The upper 20 is flexible and tightens to conform to the shape of a user's foot. The laces 40 are drawn tightly which leaves the lace edges 42, 44 of the medial 15 and lateral 14 sides, respectively, relatively close to one another. FIG. 6 shows how the footwear 10 will appear in cross section with a foot having a wide width 43. The upper 20 tightens to conform to the shape of the user's foot. When the laces are drawn tightly in this case, the lace edges 42, 44 of the medial 15 and lateral 14 sides, respectively, remain further apart to accommodate the wider width foot. Attention is also directed to the areas marked 46 and 48 on the drawings. When a wider width foot is in the shoe, the amount of upper 20 positioned beneath the foot is increased. This changes how the upper 20 appears with respect to the sole 30 to an observer.

Figure 8:
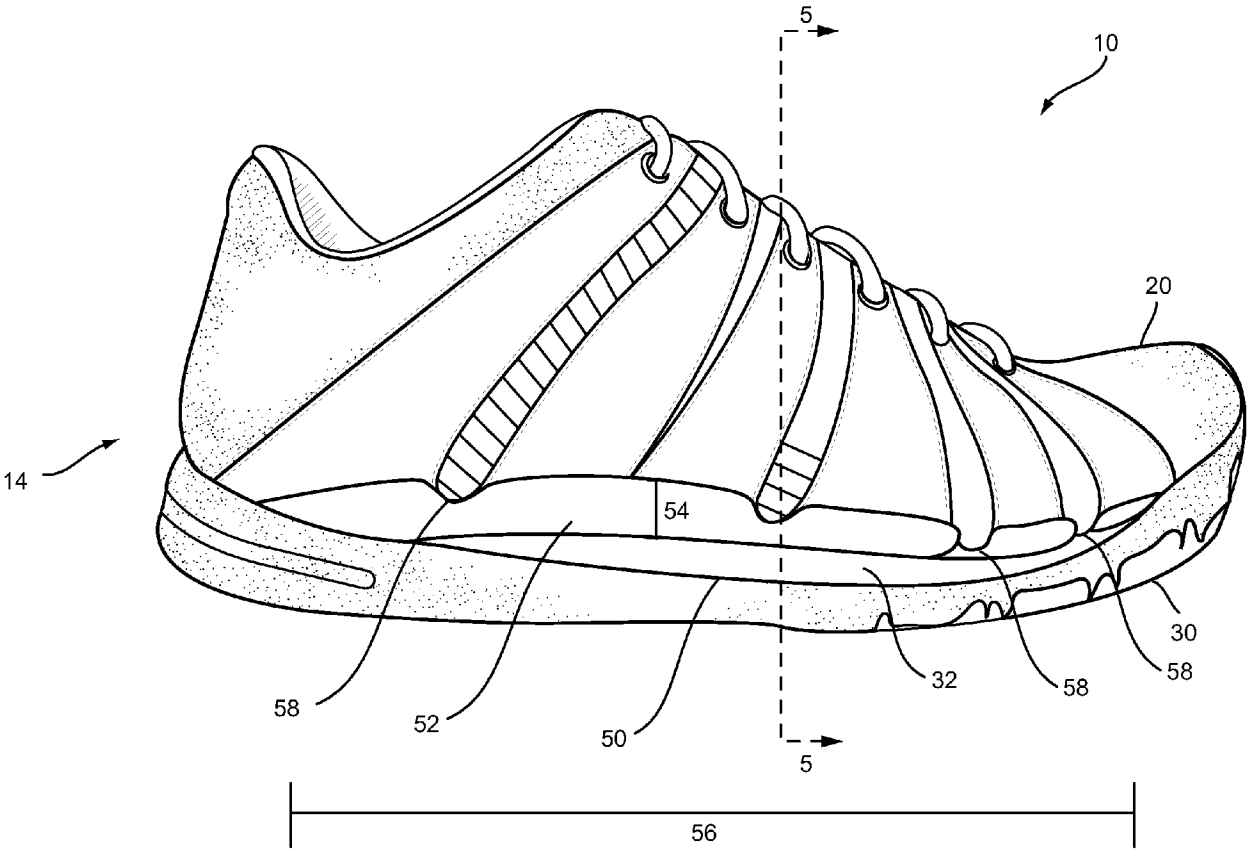
FIG. 8 is a lateral side elevational view of a first embodiment of an article of footwear.
Figure 9:
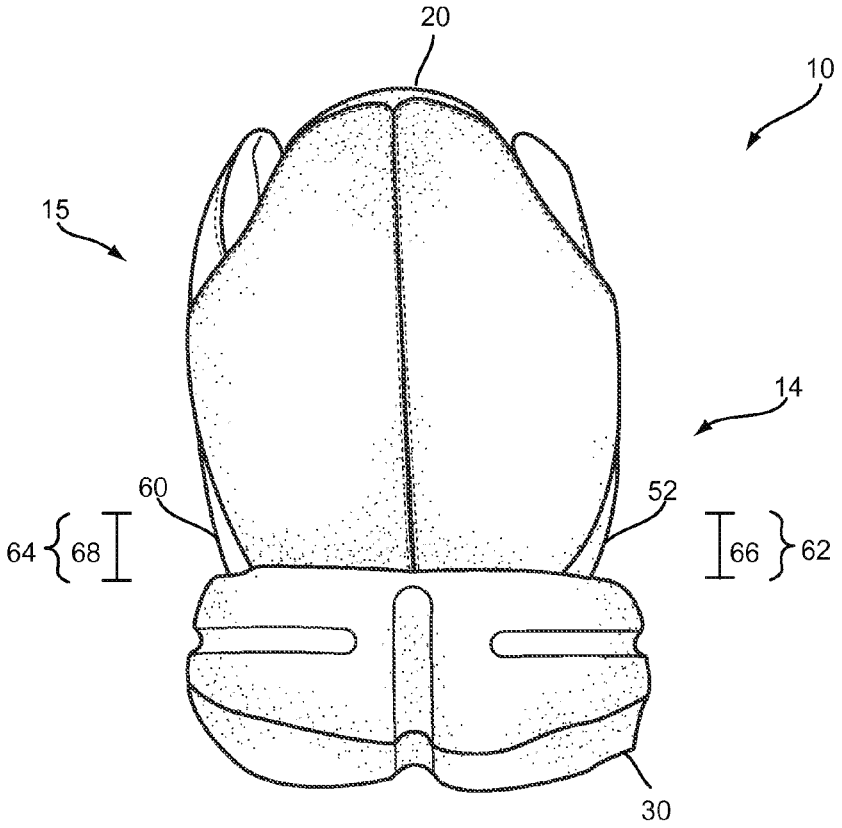
FIG. 9 is a rear elevational view of the first embodiment of the article of footwear.
Figure 10:
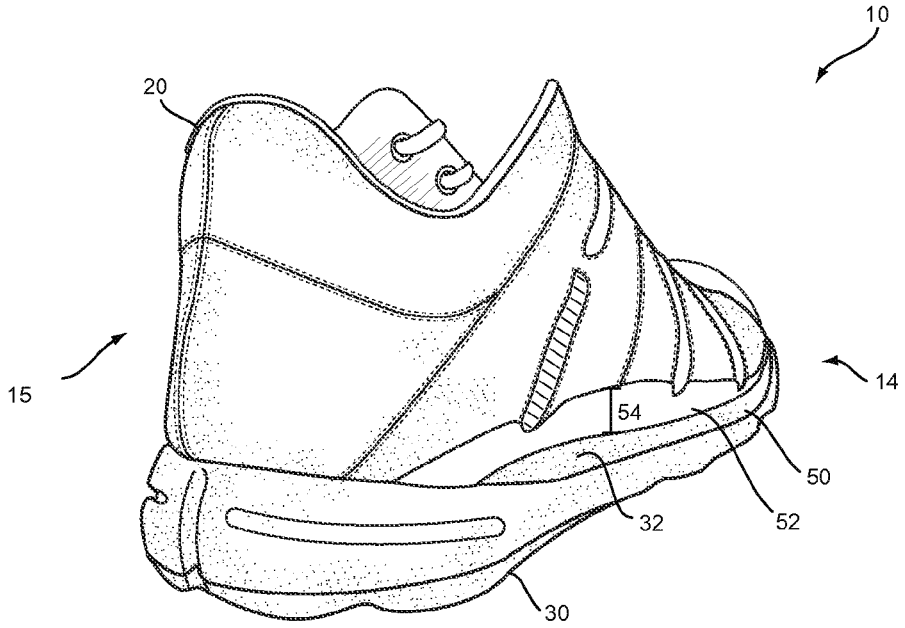
FIG. 10 is a perspective view of the first embodiment of the article of footwear.

Referring now to FIGS. 8-10, an article of footwear 10 according to the present invention is shown. As noted earlier, the article of footwear 10 includes an upper 20 and a sole 30 coupled or attached to one another. FIGS. 8 and 10 show the lateral side 14 of the footwear 10. Visible on the lateral side 14 of the footwear 10 is an open lateral portion 50 of the top surface 32 of sole 30. Adjacent the open lateral portion 50 is a lateral impact absorber 52 attached to the lateral side 15 of the upper 20. The lateral impact absorber 52 is attached to the upper 20 at least along the midfoot region 12 of the footwear 10. The lateral impact absorber 52 has a height 54 that varies along its length 56. For example, the lateral impact absorber 52 includes various indents 58 that may be included for cosmetic or functional reasons. In the illustrated embodiment of FIGS. 8 and 10, the indents 58 correspond in position to various design features of the shoe upper 20. Desirably, the height 54 of the lateral impact absorber 52 tapers or decreases to zero in the forefoot region 11 and the heel region 13 of the footwear 10.

The lateral impact absorber 52 may be made of any of a variety of materials. Consideration of an appropriate material for the lateral impact absorber 52 may take into account a variety of factors. First, the material chosen should be sufficiently flexible to allow the upper 20 to be pulled taut without hindrance from the impact absorber 52. The material chosen should also be capable of absorbing impact when compressed. Finally, the material chosen must be capable of being secured or attached to a corresponding upper material. It is preferred that the impact absorber 52 be attached via an adhesive to the upper 20. However, it could alternatively be attached via a mechanical attachment structure, such as sewing. Finally, the material chosen should be selected for its aesthetic properties since it will be positioned visibly on the outside of the footwear and its shape will be a design element of the footwear. The material and its size and shape can be tuned to the desired impact absorbing properties of the footwear.

On the medial side 15 of the footwear 10 is positioned a medial impact absorber 60 attached to the upper 20. The medial impact absorber 60 will be shown in more detail in other Figures. The medial impact absorber 60 has the same qualities and features as the lateral impact absorber 52. However, the medial impact absorber 60 may have a somewhat different size and shape from the lateral impact absorber 52 due, at least in part, to the different countours of the upper 20 and sole 30 as are common in footwear generally and specifically in footwear 10. For example, the curvature of the medial side 15 of the footwear 10 tends to be concave and the lateral side 14 tends to be convex, as is best seen in FIG. 7. However, the relative size and shape of the impact absorbers 52, 60 may differ for other reasons, such as the amount of impact the impact absorbers are designed to absorb, the position of the attachment boundaries 34, 38, aesthetic reasons, or for any other reason that a designer might consider in designing an article of footwear.

Figure 12:
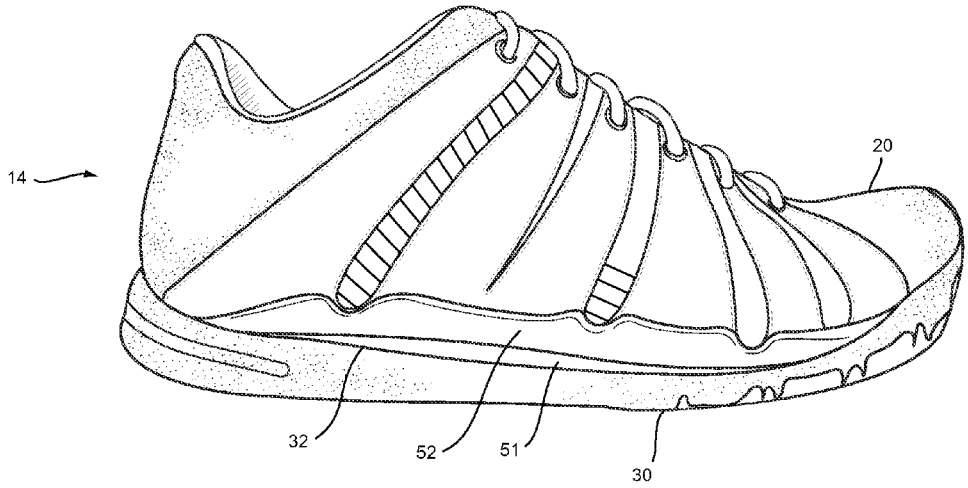
FIG. 12 is a lateral side elevational view of the first embodiment of the article of footwear when a lateral force is applied to the article of footwear.
Figure 13:
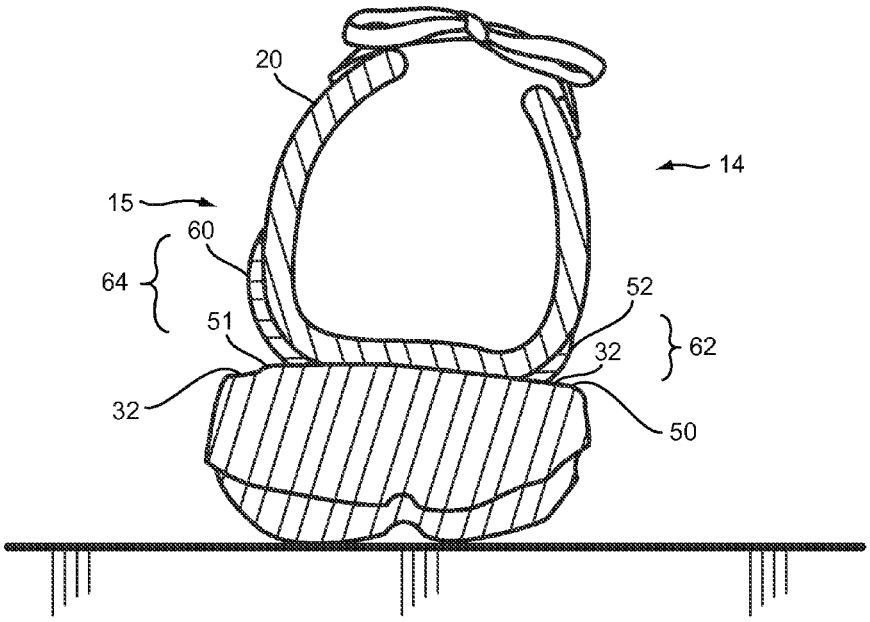
FIG. 13 is a cross-sectional view of the first embodiment of the article of footwear taken along line 13-13 of FIG. 11.

The features described above work together when a user is wearing the footwear 10 to deal with lateral and medial forces differently than prior art footwear. Looking first to FIGS. 11-13, the footwear 10 is shown when a lateral force, i.e., a force toward the lateral side 14 of the footwear 10, is applied. Such a force might be applied when a user makes a quick turn or is running around a curve. Referring first to FIG. 13, the motion of the footwear is apparent. In such an instance, the upper 20 is permitted to rotate or roll slightly towards the lateral side 14. When the upper 20 rolls towards the lateral side 14, the lateral impact absorber 52 comes into contact with the top surface 32 of the sole 30, in the open lateral area 50 of the sole 30. The lateral force or impact applied to the shoe is thereby absorbed in three ways. First, the upper 20 is permitted to roll. Next, the lateral impact absorber 52 becomes compressed. Finally, elements in the sole 30 compress. These three features combine to absorb a great degree of the impact and reduce the impact that the user's body must absorb.

Figure 11:
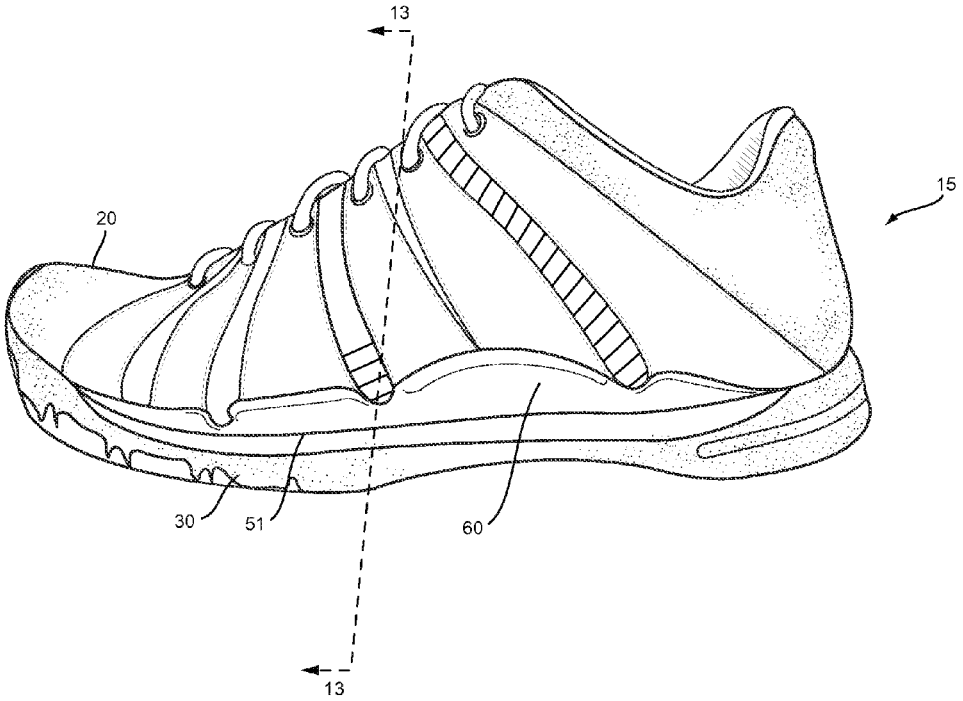
FIG. 11 is a medial side elevational view of the first embodiment of the article of footwear when a lateral force is applied to the article of footwear.

Viewing the footwear 10 from each of the lateral 14 and medial 15 sides is also illustrative of the movement of the footwear 10 when a force is applied. FIG. 11 shows the medial side 15 of the footwear 10 and FIG. 12 shows the lateral side 14 of the footwear 10. When a lateral force is applied toward the lateral side 14, the upper 20 is allowed to roll or pivot. The lateral impact absorber 52 is compressed under the user's foot against the open lateral area 50 on the top surface 32 of the sole 30. An observer looking at the footwear 10 from this lateral side 14 as in FIG. 12 will observe that the visible area of the lateral impact absorber 52 and the visible portion of the top surface 32 of the sole 30 are reduced relative to the visible portions of those elements in the rest position of the footwear as shown in FIG. 8.

Similarly, referring to FIG. 11, when the lateral force is applied toward the lateral side 14, the upper 20 is allowed to roll or pivot. The medial impact absorber 60 is released from under the user's foot and away from the open medial area 51 on the top surface 32 of the sole 30. An observer looking at the footwear 10 from this medial side 15 as in FIG. 12 will observe that the visible area of the medial impact absorber 60 and the visible portion of the top surface 32 of the sole 30 are increased relative to the visible portions of those elements in the rest position of the footwear 10.

Figure 15:
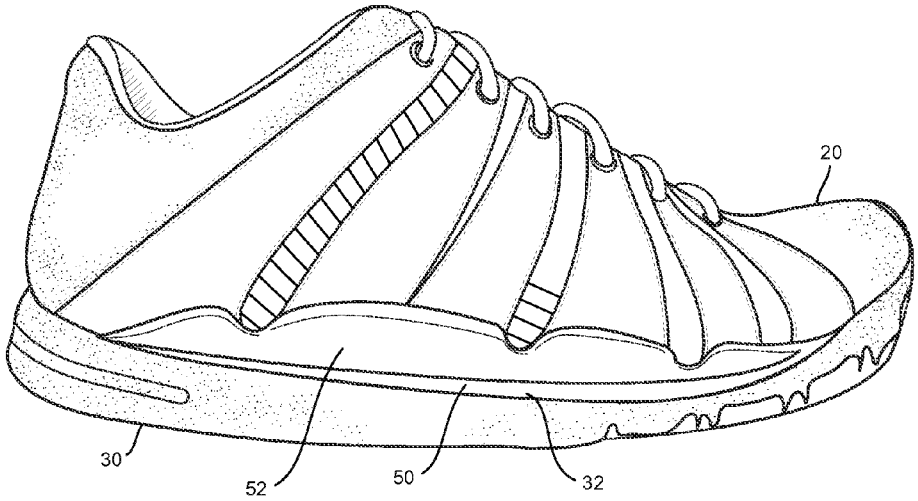
FIG. 15 is a lateral side elevational view of the first embodiment of the article of footwear when a medial force is applied to the article of footwear.
Figure 16:
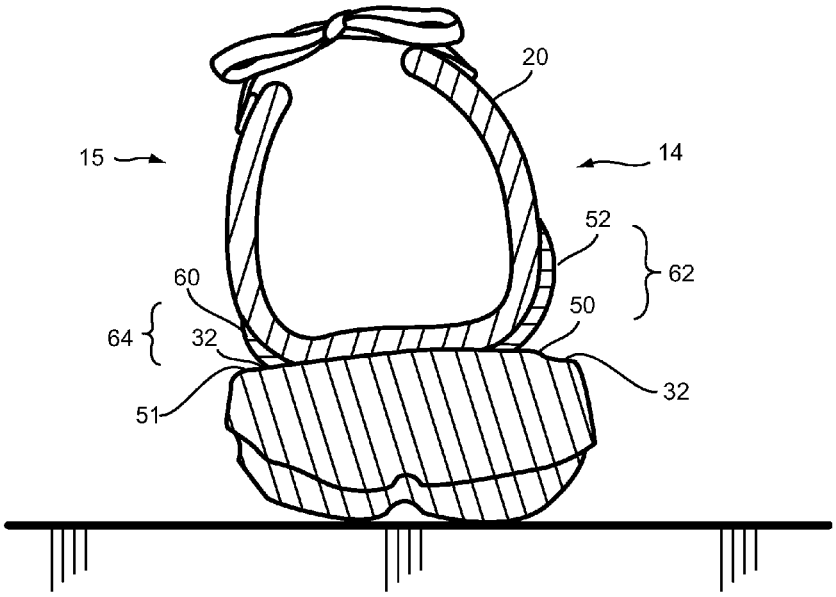
FIG. 16 is a cross-sectional view of the first embodiment of the article of footwear taken along line 16-16 of FIG. 14.

A similar result is seen when a medial force is applied to the footwear 10. Looking now to FIGS. 14-16, the footwear 10 is shown when a medial force, i.e., a force toward the medial side 15 of the footwear 10, is applied. Such a force might be applied when a user makes a quick turn or is running around a curve. Referring first to FIG. 16, the motion of the footwear 10 is apparent. In such an instance, the upper 20 is permitted to rotate or roll slightly towards the medial side 14. When the upper 20 rolls towards the medial side 14, the medial impact absorber 60 comes into contact with the top surface 32 of the sole 30, in the open medial area 51 of the sole 30. The medial force or impact applied to the shoe is thereby absorbed in three ways. First, the upper 20 is permitted to roll. Next, the medial impact absorber 60 becomes compressed. Finally, elements in the sole 30 compress. These three features combine to absorb a great degree of the impact and reduce the impact that the user's body must absorb.

Figure 14:
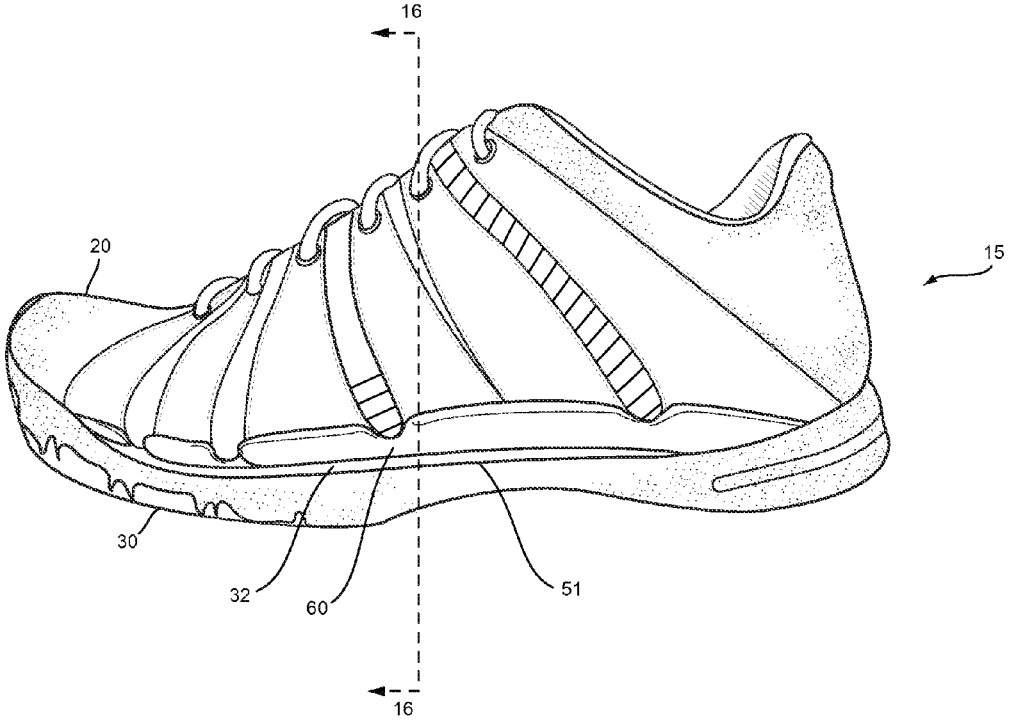
FIG. 14 is a medial side elevational view of the first embodiment of the article of footwear when a medial force is applied to the article of footwear.

Viewing the footwear 10 from each of the lateral 14 and medial 15 sides is also illustrative of the movement of the footwear 10 when a force is applied. FIG. 14 shows the medial side 15 of the footwear 10 and FIG. 15 shows the lateral side 14 of the footwear 10. When a medial force is applied toward the medial side 15, the upper 20 is allowed to roll or pivot. The medial impact absorber 60 is compressed under the user's foot against the open medial area 51 on the top surface 32 of the sole 30. An observer looking at the footwear 10 from this medial side 15 as in FIG. 14 will observe that the visible area of the medial impact absorber 60 and the visible portion of the top surface 32 of the sole 30 are reduced relative to the visible portions of those elements in the rest position of the footwear.

Similarly, referring to FIG. 15, when the medial force is applied toward the medial side 15, the upper 20 is allowed to roll or pivot. The lateral impact absorber 52 is released from under the user's foot and away from the open lateral area 50 on the top surface 32 of the sole 30. An observer looking at the footwear 10 from this lateral side 14 as in FIG. 15 will observe that the visible area of the lateral impact absorber 52 and the visible portion of the top surface 32 of the sole 30 are increased relative to the visible portions of those elements in the rest position of the footwear 10 as seen in FIG. 8.

A review of FIGS. 4-14 and particularly the cross sectional views in FIGS. 7, 8, 11, and 14 and the rear elevational view of FIG. 5 reveals another feature. Referring to the upper 20, on each of the medial side and the lateral side, there exists a free area 64, 62, respectively, that in a standard article of footwear would be likely attached to the sole. Because the upper 20 is attached to the sole 30 along lateral and medial attachment boundaries 38, 34, the free areas 64, 62 of the upper are able to be positioned in varying angles from the top surface 32 of the sole 30. The free areas 64, 62 are located at least in the midfoot region 12 of the footwear 10. In the embodiment shown in FIGS. 4-14, the impact absorbers 60, 52 are attached to the respective free areas 64, 62 of the upper 20. The lateral free area 62 may differ in size and shape than the medial free area 64 for various reasons, including the standard curvature of the footwear in the midfoot region 12 and the assymetrical attachment of the upper 32 to the sole 30. Also for these reasons, the heights 66, 68 of the free areas 62, 64 vary along their length and taper or decrease to zero at their longitudinal ends in the forefoot and heel regions.

Figure 17:
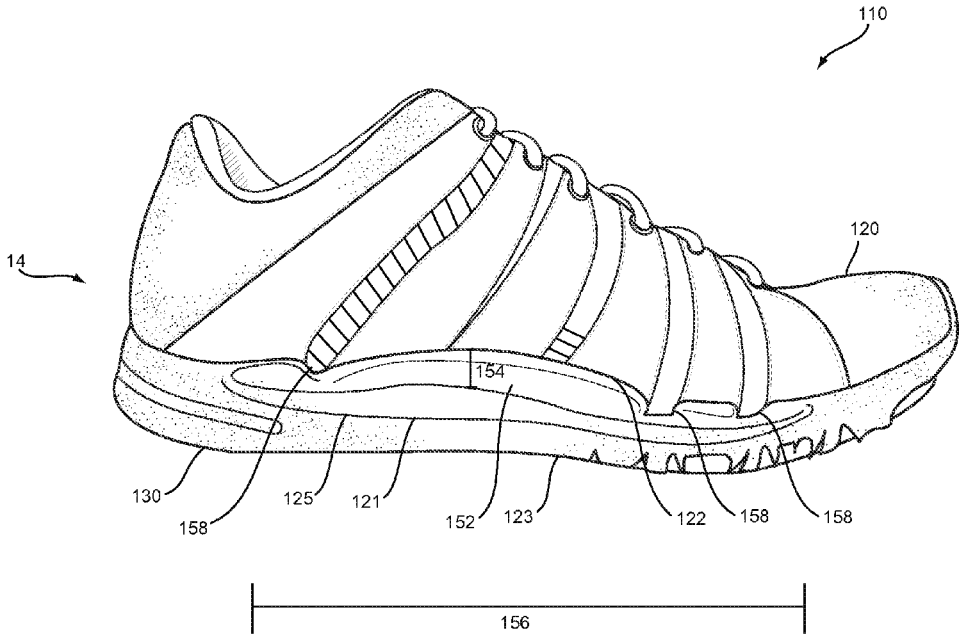
FIG. 17 is a lateral side elevational view of a second embodiment of an article of footwear.
Figure 18:
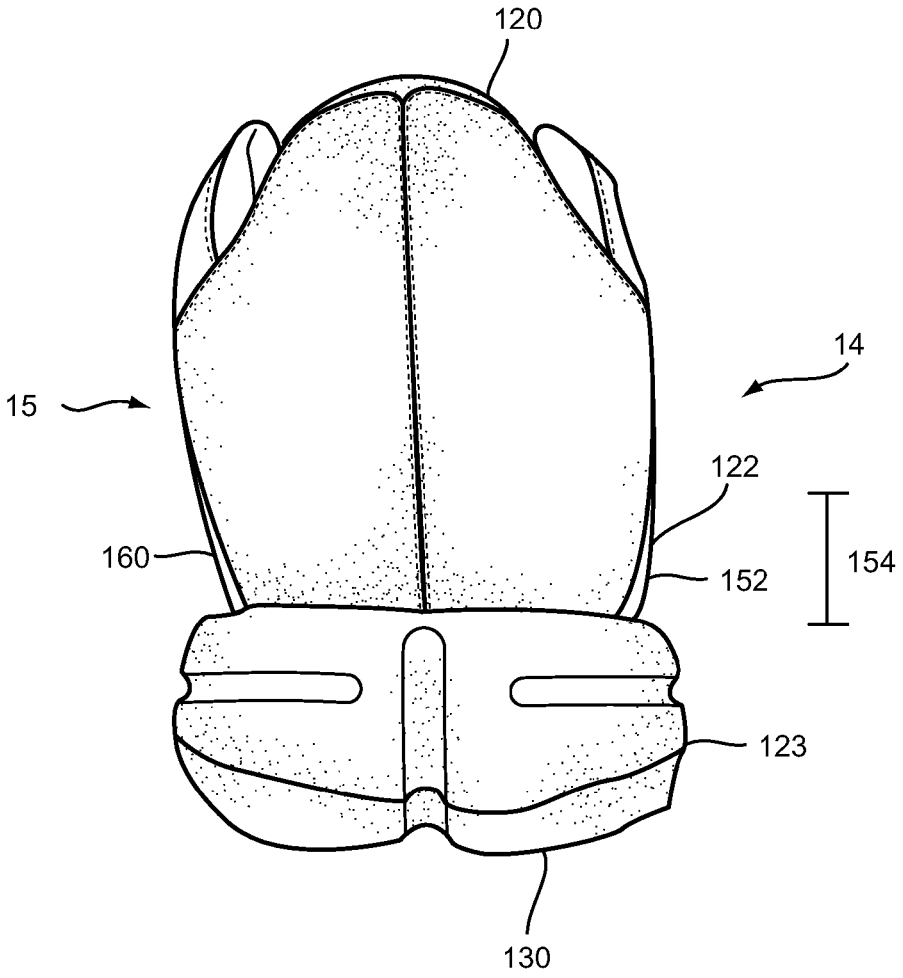
FIG. 18 is a rear elevational view of the second embodiment of the article of footwear.
Figure 19:
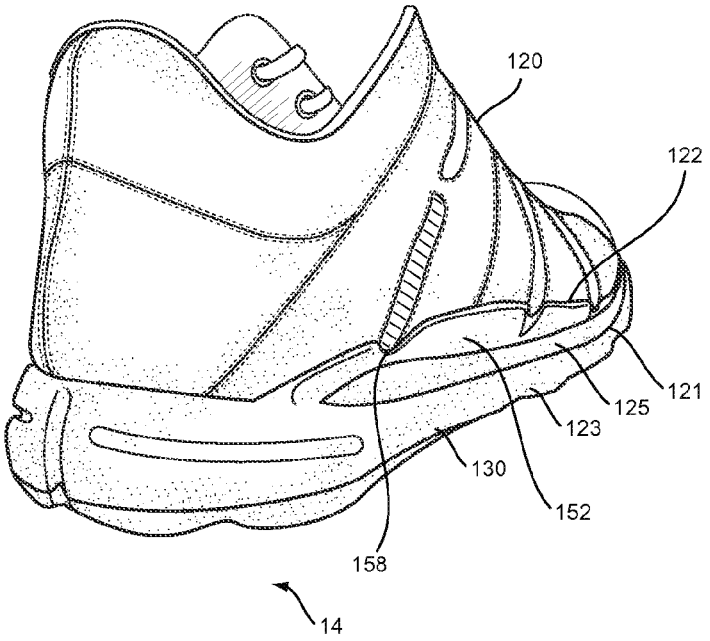
FIG. 19 is a perspective view of the second embodiment of the article of footwear.

A second embodiment of the present invention is shown in FIGS. 17-26. FIGS. 17-19 show an overview of the structure. The footwear 110 is identical in many respects to the footwear 10 described earlier, including the placement of forefoot, midfoot, and heel regions 11, 12, 13 and lateral and medial sides 14, 15. The footwear 110 also includes an upper 120 that is substantially the same as that described in relation to the earlier embodiment. Numerals from the first embodiment are used identically in this embodiment to describe the same features.

Turning first to FIGS. 17-19, a second embodiment of the footwear 110 is shown. The footwear includes an upper 120 and a sole 130 coupled or attached to one another. FIGS. 17 and 19 show the lateral side 14 of the footwear 110. As particularly seen in these Figs., the sole 130 defines a lateral recess or undercut 121 at least in a midfoot region 12 of the footwear 110. In the area where there is a lateral recess 121, the sole 130 is split into a top portion 122 and a lower portion 123 that are separated from each other by the lateral recess 121, particularly along a periphery 36 of the sole 130. In this embodiment, the use of the lateral and medial recesses 121, 124 allows rotational freedom between the top portion 122 and lower portion 123 of the sole 130 in the peripheral areas 36 in the midfoot region 12 where the top and lower portions 122, 123 are separated.

Figure 20:
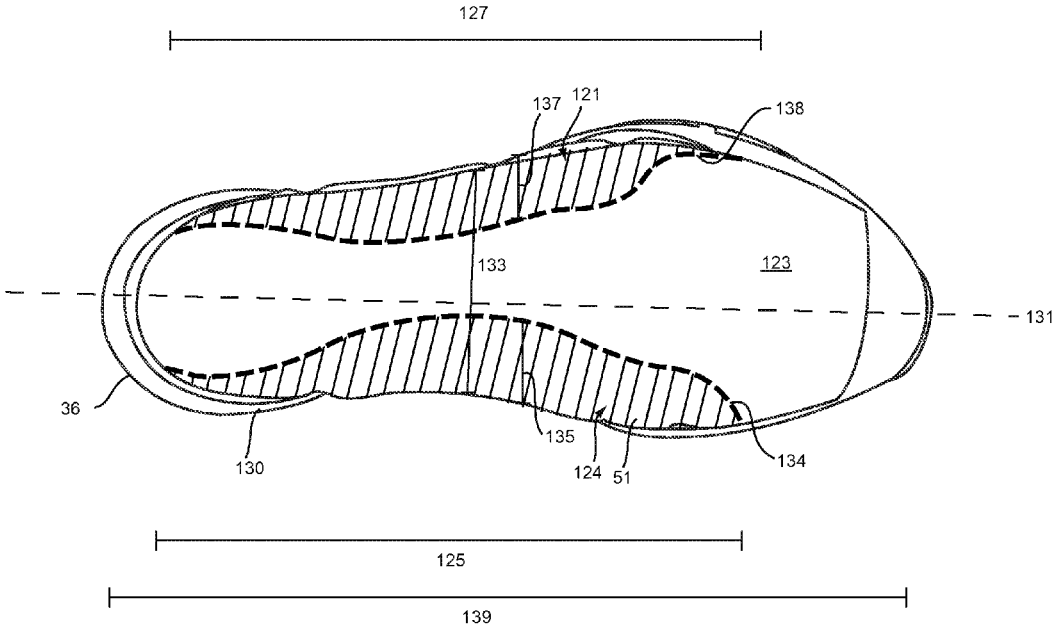
FIG. 20 is a top view of the lower portion of a sole of an article of footwear according to the invention showing the positioning of the top portion of the sole relative to the lower portion of the sole.

FIG. 20 shows how the recesses 121, 124 can be configured relative to the sole. FIG. 20 is a view showing the lower portion 123 of the sole 130. Axis 131 shows an approximate axis along the center of the lower portion 123 of the sole 130. A first dashed line 138 is one embodiment of the lateral inner limit of the lateral recess 121. This lateral inner limit 138 is located or spaced inward from the periphery or peripheral edge 36 of the sole 130. The lateral inner limit 138 need not be a consistent distance from the periphery 36 of the sole 130. Instead, as shown in FIG. 20, the lateral inner limit 138 approaches and then contacts the periphery 36 as the lateral inner limit 138 nears the forefoot region 11 and heel region 13. The lateral inner limit 138 is most clearly spaced from the periphery 36 in the midfoot region 12.

Similarly, a second dashed line is one embodiment of a medial inner limit 134 that represents the inner limit of the medial recess 124. This medial inner limit 134 is located or spaced inward from the periphery or peripheral edge 36 of the sole 130. The medial inner limit 134 need not be a consistent distance from the periphery 36 of the sole 130. Instead, as shown in FIG. 20, the medial inner limit 134 approaches and then contacts the periphery 36 as the medial inner limit 134 nears the forefoot region 11 and heel region 13. The medial inner limit 134 is most clearly spaced from the periphery 36 in the midfoot region 12.

The sole 130 can be formed in a number of ways to create this structure. The sole 130 can be molded in one piece so that the top portion 122 and the lower portion 123 are integrally formed. If the sole 130 is formed in this manner, the mold can contain inserts to form the recesses 121, 124 in the sole at the time of molding. Alternatively, the recesses 121, 124 can be machined into the sole 130 after molding. The top portion 122 and lower portion 123 can alternatively be formed separately from one another and then bonded together. Such a configuration would be desirable when, for example, it is desired to use different materials for the top portion 122 and lower portion 123. If the top portion 122 and lower portion 123 are formed separately, the medial and lateral sides of the top portion 122 can also be formed separately from one another and separately secured to the lower portion 123. The method and structure for securing the parts together can be selected by a person having ordinary skill in the art without undue experimentation, and will be based on the materials selected for the portions of the sole 130 and the desired strength of the final product. Regardless of the method of making the sole 130, if both the top portion 122 and the lower portion 123 extend into the forefoot area 11 and heel area 13, the peripheral edges 36 of the two should be continuous.

The top portion 122 of the sole 130 is attached or coupled to the upper 120. Because the top portion 122 of the sole 130 is separate from the lower portion 123 of the sole 130 in at least a midfoot region 12, the top portion 122 and upper 120 are effectively attached to the lower portion 123 of the sole 130 only in an area spaced from the periphery 36 of the lower portion 123 of the sole 130, as is best shown in FIG. 20. In the toe region 11 and the heel region 13, the upper 120 is attached or coupled to the sole 130 in an area that is along the periphery 36 of the sole 130. While the upper 120 may be spaced a small distance from the periphery 36 of the sole 130 in the toe region 11 and heel region 13, the upper is attached or coupled about at the periphery 36 and along the periphery 36.

The configuration shown in FIG. 20 is one possible configuration of the positioning and attachment and coupling of the upper 120 and top portion 122 of the sole 130 relative to the lower portion 123 of the sole 30. In this configuration, the lower portion 123 of the sole 130 has a width 133. The width or distance 135 represents the distance the medial inner limit 134 is positioned from the periphery 36 in a particular location along the length 125 of the medial recess 124. The width or distance 137 represents the distance the lateral inner limit 138 is positioned from the periphery 36 in a particular location along the length 127 of the lateral recess 121. It is desirable that for any embodiment of the footwear 10, that at least one of the width 135 and the width 137 be at least 10% of the width 133 of the lower portion 123 of the sole 130. The inner limits 134, 138 may be positioned on the sole 130 so that the upper 120 and the lower portion 123 of the sole 130 are effectively coupled either symmetrically or asymmetrically about axis 131. As an upper limit, it is of course possible that width 137 and width 135 could be great enough that the inner limits 134, 138 would be in substantially the same location on the sole 130. In such an instance, width 135 and width 137 might each have a value of about 50% the value of width 133. Alternatively, if desired, width 137 might have a value of about 60% of width 133 and width 135 might have a value of about 40% of width 133. Of course, the position of each inner limit 134, 138 may be tuned for a particular desired footwear application, and the values of width 137 and width 135 can vary widely, except that of course, the values of width 137 and width 135 added together can never exceed the value of width 133 at any given point along the length 139 of the sole 130. Finally, in some cases, it is possible that the value of width 135 or width 137 in a particular case would be close to zero and that the top portion 122 and the lower portion 123 of the sole 130 would be attached at one of the medial side 15 or lateral side 14 at an area along the periphery 36 of the sole 130 and their respective lengths 125, 127. It is also to be noted that the value of both width 135 and of width 137 vary along the length 139 of the sole 130. The width 135 and the width 137 taper to a zero value in the areas of the forefoot region 11 and the heel region 13. As shown in FIG. 20, based on the contours of the sole 130 and the inner limits 134, 138, the value of width 135 and width 137 may, but need not, gradually increase to a single high value.

In the present configuration, the top portion 122 of the sole 130 acts as an impact absorber in the area where it is secured or coupled to the upper 120. The lateral impact absorber 152 has a height 154 that varies along its length 156. For example, the lateral impact absorber 152 includes various indents 158 that may be included for cosmetic or functional reasons. In the illustrated embodiment of FIGS. 17 and 19, the indents 158 correspond in position to various design features of the shoe upper 120. Desirably, the height 154 of the lateral impact absorber 152 tapers or decreases to zero in the forefoot region 11 and the heel region 13 of the footwear 110.

The impact absorbers 152, 160 may be made of any of a variety of materials. Consideration of an appropriate material for the impact absorbers 152, 160 may take into account a variety of factors in addition to those discussed above in considering the manufacture of the sole 130 generally. First, the material chosen should be sufficiently flexible to allow the upper 120 to be pulled taut without hindrance from the impact absorbers 152, 160. The material chosen should also be capable of absorbing impact when compressed. Finally, the material chosen must be capable of being secured or attached to a corresponding upper material. It is preferred that the impact absorber 152 be attached via an adhesive to the upper 120. However, it could alternatively be attached via a mechanical attachment structure, such as sewing. Finally, the material chosen should be selected for its aesthetic properties since it will be positioned visibly on the outside of the footwear and its shape will be a design element of the footwear. The material and its size and shape can be tuned to the desired impact absorbing properties of the footwear.

On the medial side 15 of the footwear 110 is positioned a medial impact absorber 160 attached to the upper 120. The medial impact absorber 160 will be shown in more detail in other Figures. The medial impact absorber 160 has the same qualities and features as the lateral impact absorber 152. However, the medial impact absorber 160 may have a somewhat different size and shape from the lateral impact absorber 152 due, at least in part, to the different contours of the upper 120 and sole 130 as are common in footwear generally and specifically in footwear 110. For example, the curvature of the medial side 15 of the footwear 110 tends to be concave and the lateral side 14 tends to be convex, as is best seen in FIG. 20. However, the relative size and shape of the impact absorbers 152, 160 may differ for other reasons, such as the amount of impact the impact absorbers are designed to absorb, the position of the inner limits 134, 138, aesthetic reasons, or for any other reason that a designer might consider in designing an article of footwear.

Figure 22:
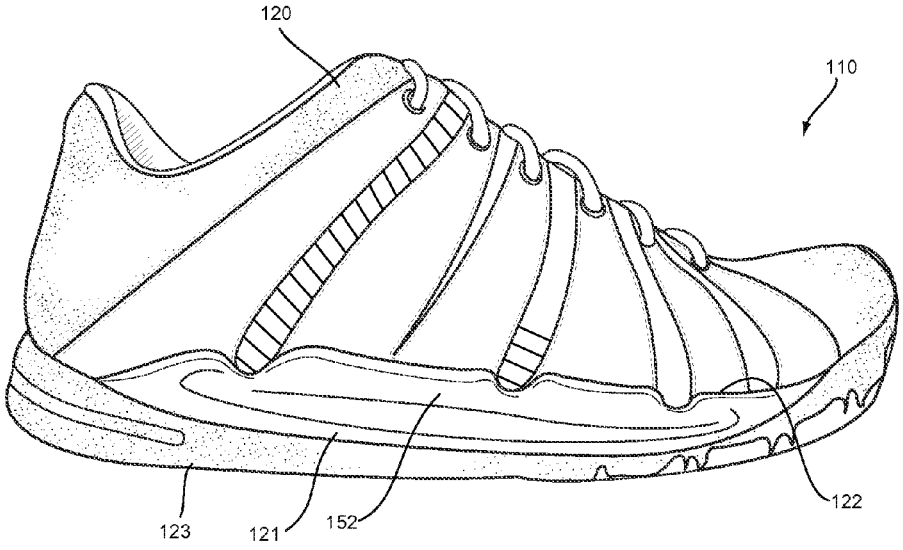
FIG. 22 is a lateral side elevational view of the second embodiment of the article of footwear when a lateral force is applied to the article of footwear.
Figure 23:
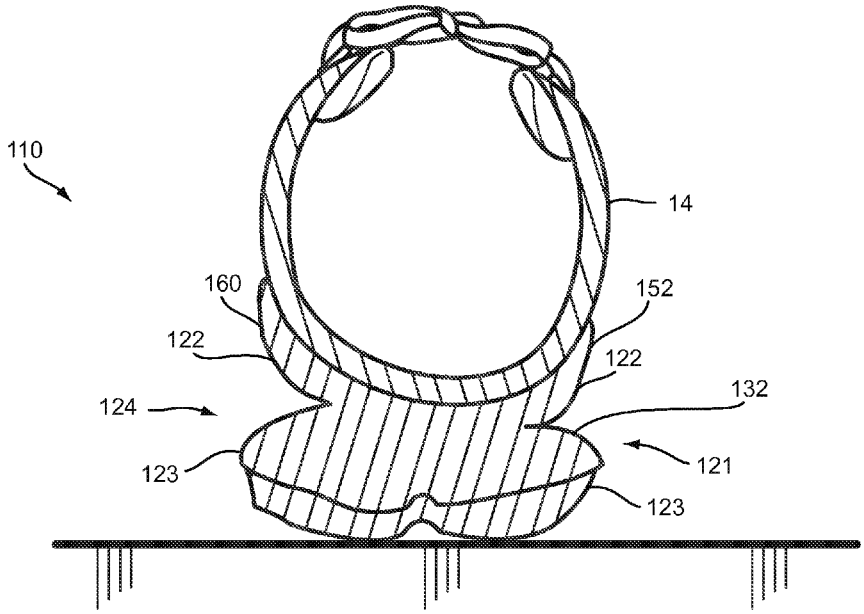
FIG. 23 is a cross-sectional view of the second embodiment of the article of footwear taken along line 23-23 of FIG. 21.

The features described above work together when a user is wearing the footwear 110 to deal with lateral and medial forces differently than prior art footwear. Looking first to FIGS. 21-23, the footwear 110 is shown when a lateral force, i.e., a force toward the lateral side 14 of the footwear 110, is applied. Such a force might be applied when a user makes a quick turn or is running around a curve. Referring first to FIG. 23, the motion of the footwear is apparent. In such an instance, the upper 120 is permitted to rotate or roll slightly towards the lateral side 14. When the upper 120 rolls towards the lateral side 14, the lateral impact absorber 152 comes into contact with the top surface 132 of the lower portion 123 of the sole 130. The lateral force or impact applied to the shoe is thereby absorbed in three ways. First, the upper 120 is permitted to roll. Next, the lateral impact absorber 152 becomes compressed. Finally, elements in the sole 130 compress. These three features combine to absorb a great degree of the impact and reduce the impact that the user's body must absorb.

Figure 21:
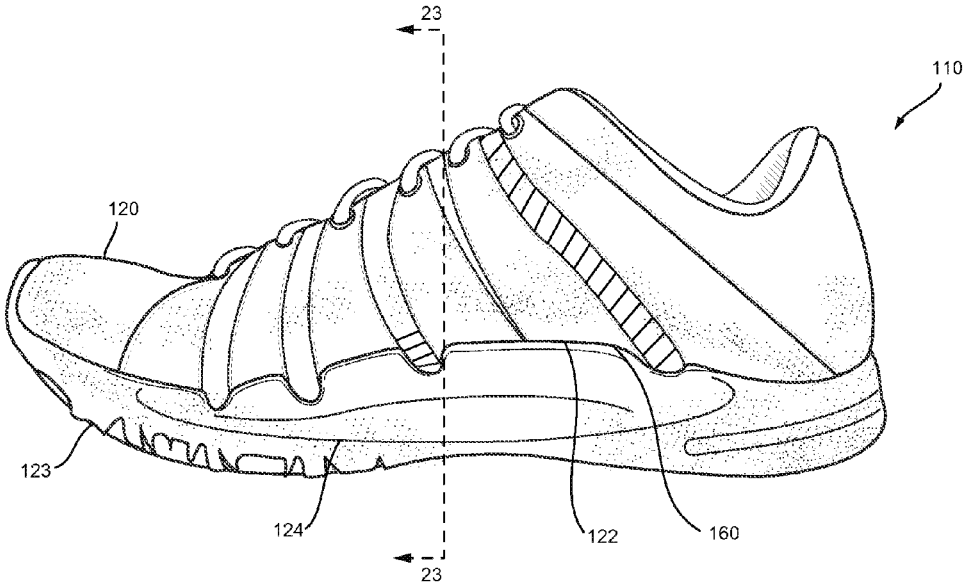
FIG. 21 is a medial side elevational view of the second embodiment of the article of footwear when a lateral force is applied to the article of footwear.

Viewing the footwear 110 from each of the lateral 14 and medial 15 sides is also illustrative of the movement of the footwear 110 when a force is applied. FIG. 21 shows the medial side 15 of the footwear 110 and FIG. 22 shows the lateral side 14 of the footwear 110. When a lateral force is applied toward the lateral side 14, the upper 120 is allowed to roll or pivot. The lateral impact absorber 152 is compressed under the user's foot against lower portion 123 of the sole 130. An observer looking at the footwear 10 from this lateral side 14 as in FIG. 22 will observe that the visible area of the lateral impact absorber 52 and the visible portion of the lateral recess 121 of the sole 30 are reduced relative to the visible portions of those elements in the rest position of the footwear as shown in FIG. 17.

Similarly, referring to FIG. 21, when the lateral force is applied toward the lateral side 14, the upper 120 is allowed to roll or pivot. The medial impact absorber 160 is released from under the user's foot and away from the lower portion 123 of the sole 30. An observer looking at the footwear 110 from this medial side 15 as in FIG. 21 will observe that the visible area of the medial impact absorber 160 and the visible portion of the medial recess 124 are increased relative to the visible portions of those elements in the rest position of the footwear 110.

Figure 25:
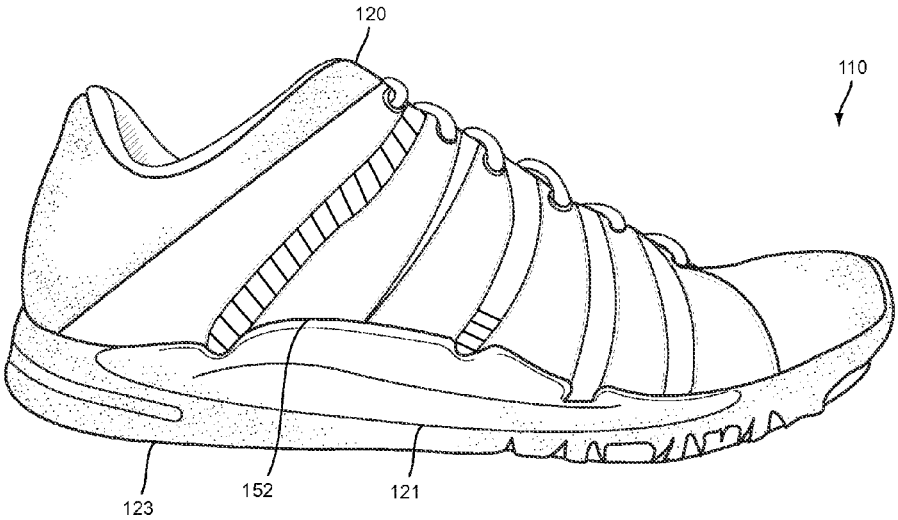
FIG. 25 is a lateral side elevational view of the second embodiment of the article of footwear when a medial force is applied to the article of footwear.
Figure 26:
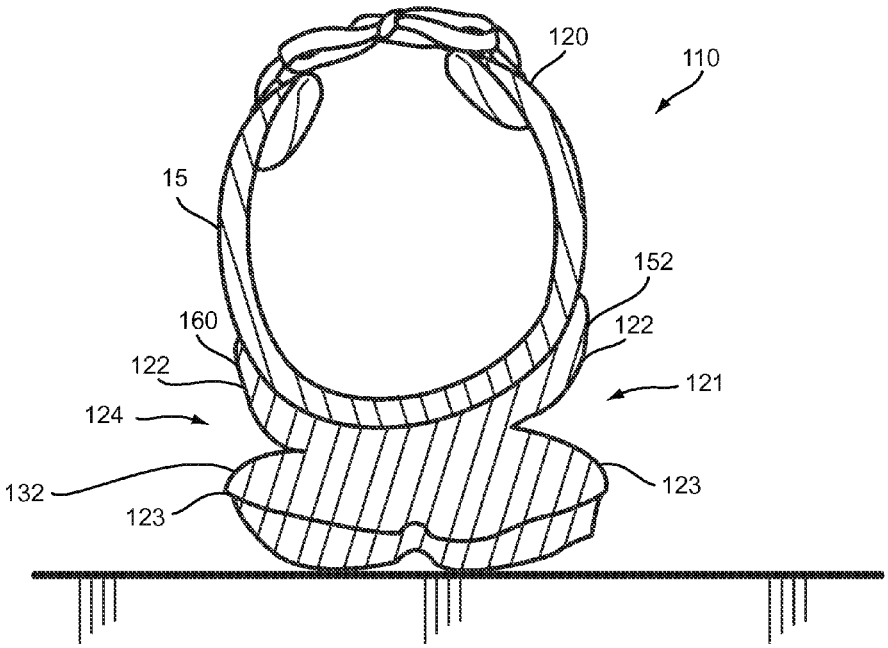
FIG. 26 is a cross-sectional view of the second embodiment of the article of footwear taken along line 26-26 of FIG. 24.

A similar result is seen when a medial force is applied to the footwear 110. Looking now to FIGS. 24-26, the footwear 10 is shown when a medial force, i.e., a force toward the medial side 15 of the footwear 10, is applied. Such a force might be applied when a user makes a quick turn or is running around a curve. Referring first to FIG. 26, the motion of the footwear is apparent. In such an instance, the upper 120 is permitted to rotate or roll slightly towards the medial side 15. When the upper 120 rolls towards the medial side 15, the medial impact absorber 160 comes into contact with the top surface 132 of the lower portion 123 of sole 130. The medial force or impact applied to the shoe is thereby absorbed in three ways. First, the upper 120 is permitted to roll. Next, the medial impact absorber 160 becomes compressed. Finally, elements in the sole 130 compress. These three features combine to absorb a great degree of the impact and reduce the impact that the user's body must absorb.

Figure 24:
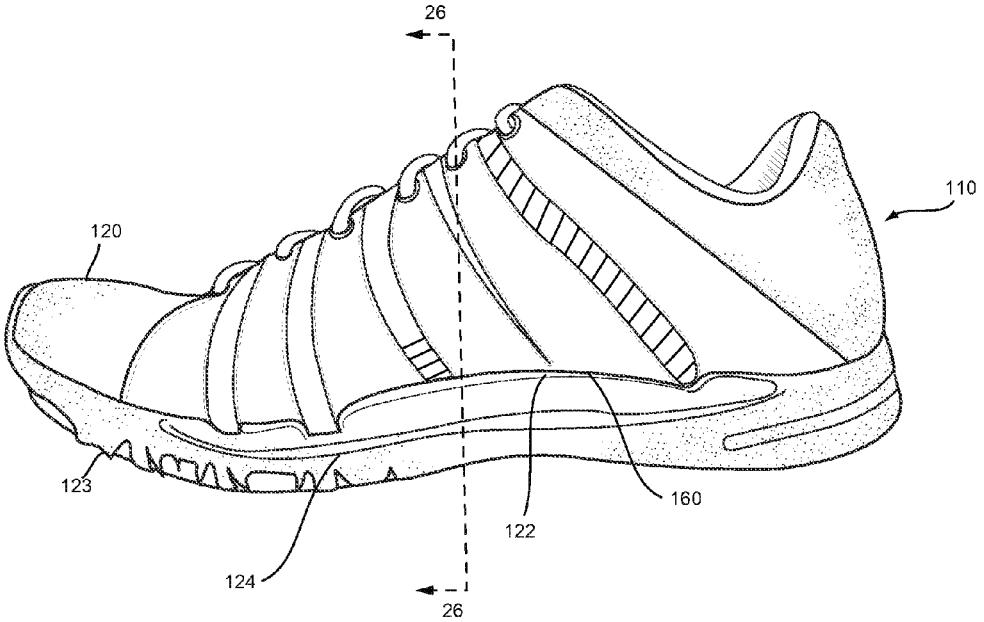
FIG. 24 is a medial side elevational view of the second embodiment of the article of footwear when a medial force is applied to the article of footwear.

Viewing the footwear 110 from each of the lateral 14 and medial 15 sides is also illustrative of the movement of the footwear 110 when a force is applied. FIG. 24 shows the medial side 15 of the footwear 110 and FIG. 25 shows the lateral side 14 of the footwear 110. When a medial force is applied toward the medial side 15, the upper 120 is allowed to roll or pivot. The medial impact absorber 160 is compressed under the user's foot against the lower portion 123 of the sole 130. An observer looking at the footwear 110 from this medial side 15 as in FIG. 24 will observe that the visible area of the medial impact absorber 160 and the visible portion of the medial recess 124 are reduced relative to the visible portions of those elements in the rest position of the footwear.

Similarly, referring to FIG. 24, when the medial force is applied toward the medial side 15, the upper 120 is allowed to roll or pivot. The lateral impact absorber 152 is released from under the user's foot and away from the lower portion 123 of the sole 130. An observer looking at the footwear 110 from this lateral side 14 as in FIG. 24 will observe that the visible area of the lateral impact absorber 152 and the visible portion of lateral recess 121 are increased relative to the visible portions of those elements in the rest position of the footwear 110 as seen in FIG. 17.

The embodiments detailed above include medial and lateral impact absorbers attached on the outside of an upper. It is to be appreciated that for aesthetic reasons, reasons of manufacturability, or other reasons deemed important by a designer, the impact absorbers could be attached to the inner surface of the upper adjacent the foot or could be incorporated between various layers of material in the upper. In such an instance, while the impact absorbers would not be visible, they would still be impact absorbers attached to the upper as discussed herein. In still a further embodiment, the impact absorbers can be minimized or eliminated if desirable for a given application.

The invention is disclosed above and in the accompanying drawings with reference to a variety of embodiments. The purpose served by the disclosure, however, is to provide an example of the various features and concepts related to the invention, not to limit the scope of the invention. One skilled in the relevant art will recognize that numerous variations and modifications may be made to the embodiments described above without departing from the scope of the present invention, as defined by the appended claims.

The invention claimed is:

1. An article of footwear, comprising:

an upper having an outermost wall that provides an exterior surface of the upper;

a sole having a top surface attached to the upper and a bottom surface disposed opposite of the top surface, the bottom surface being configured to contact a ground surface, wherein the top surface and the bottom surface of the sole extend continuously along a length of the article of footwear from a heel region to a forefoot region;

wherein the top surface of the sole is continuously attached to a center portion of the outermost wall of the upper extending along a longitudinal direction between the heel region and the forefoot region;

wherein the top surface of the sole is further attached to the outermost wall of the upper at a boundary area disposed in a midfoot region, the boundary area being spaced inwards from a peripheral edge of the sole in a lateral direction;

wherein the outermost wall of the upper is coupled to the top surface of the sole along a periphery of the sole in both the forefoot region and the heel region;

an impact absorber disposed separately from the sole, the impact absorber being attached to the exterior surface of the outermost wall of the upper at least along the midfoot region of the upper adjacent to the boundary area and extending outward towards the peripheral edge of the sole along the lateral direction, wherein the impact absorber is configured to absorb a portion of a lateral impact when the impact absorber is moved into contact with the top surface of the sole from an initial position that is spaced apart from the top surface of the sole;

wherein the impact absorber is attached to a rolling portion of the outermost wall of the upper; and wherein, through the midfoot region, the inward spacing of the boundary area allows at least a lower portion of the rolling portion to move between the initial position in which the at least a lower portion of the rolling portion and at least a lower portion of the impact absorber extend generally vertically away from the top surface of the sole and a subsequent position in which the at least a lower portion of the rolling portion and the at least a lower portion of the impact absorber extend generally horizontally over the top surface of the sole and cover an area of the top surface between the boundary area and the peripheral edge that is greater than in the initial position, with the at least a lower portion of the impact absorber contacting the top surface of the sole.

2. The article of footwear according to claim 1, wherein the impact absorber has a height that varies along a length of the impact absorber.

3. The article of footwear according to claim 2, wherein the height of the impact absorber decreases in the forefoot region and the heel region.

4. The article of footwear according to claim 1, wherein a first impact absorber is attached along a medial side of the upper and a second impact absorber is attached along a lateral side of the upper.

5. The article of footwear according to claim 4, wherein the first impact absorber differs in size and shape from the second impact absorber.

6. The article of footwear according to claim 1, wherein the too surface of the sole is generally horizontal;

wherein, in the initial position, an open portion of the top surface of the sole is visible; and wherein, in the subsequent position, a reduced area of the open portion of the top surface of the sole is visible.

7. The article of footwear according to claim 1, wherein the top surface of the sole and the outermost wall of the upper are attached asymmetrically on a medial side and a lateral side across the lateral direction.

8. An article of footwear, comprising:

a sole having a top surface and a bottom surface disposed opposite of the top surface, the bottom surface being configured to contact a ground surface, the sole being configured to support a plurality of feet having different widths, the top surface and the bottom surface of the sole extending continuously along a length of the article of footwear from a heel region to a forefoot region;

an upper having an outermost wall made of a flexible material configured to conform to the widths associated with each of the plurality of feet;

wherein the top surface of the sole is continuously attached to a center portion of the outermost wall of the upper extending along a longitudinal direction between the heel region and the forefoot region;

wherein the top surface of the sole is attached to the outermost wall of the upper along a peripheral edge of the sole at the forefoot region and the heel region;

wherein the top surface of the sole is further attached to the outermost wall of the upper at a boundary area disposed in a midfoot region, the boundary area being spaced inwards from the peripheral edge of the sole in a lateral direction;

wherein the outermost wall of the upper is attached to the top surface of the sole in a manner allowing a free area of the outermost wall of the upper, which is unattached to the top surface of the sole, to be positioned in varying angles from the top surface of the sole, when viewed in a cross-section of the article of footwear taken perpendicularly to the longitudinal direction; and wherein, through the midfoot region, the inward spacing of the boundary area allows at least a lower portion of the free area of the outermost wall of the upper to move between a first position in which the at least a lower portion of the free area extends generally vertically away from the top surface of the sole and a second position in which the at least a lower portion of the free area extends generally horizontally over the top surface of the sole and covers an area of the top surface between the boundary area and the peripheral edge that is greater than in the first position.

9. The article of footwear according to claim 8, further comprising an impact absorber attached to the free area of the outermost wall of the upper;

wherein, in the second position, a contacting portion of the impact absorber contacts and covers the area of the top surface; and wherein, in the first position, the contacting portion of the impact absorber is spaced apart from the area of the top surface such that the area of the top surface is exposed.

10. The article of footwear according to claim 9, wherein the height of the free area decreases at its longitudinal ends.

11. The article of footwear according to claim 9, wherein the impact absorber is attached to an exterior surface of the outermost wall of the upper at least along the midfoot region of the upper adjacent to the boundary area and extending outward towards the peripheral edge of the sole along the lateral direction.

12. The article of footwear according to claim 8, wherein the outermost wall of the upper includes a first free area on a lateral side and a second free area on a medial side.

13. The article of footwear according to claim 12, wherein a size and shape of the first free area differs from a size and shape of the second free area.

14. The article of footwear according to claim 8, wherein the free area is at least in the midfoot region of the upper.

15. The article of footwear according to claim 8, wherein the free area has a height and a length, the height of the free area varying along its length.

16. The article of footwear according to claim 8, wherein, in the first position, an open portion of the top surface of the sole is visible, wherein, upon lateral impact, the outermost wall of the upper is configured to roll from the first position to the second position so that the free area of the outermost wall of the upper covers the top surface of the sole and a reduced area of the open portion of the top surface of the sole is visible.

17. The article of footwear according to claim 8, wherein the outermost wall of the upper and the sole are attached asymmetrically on a medial side and a lateral side across the lateral direction.

18. An article of footwear, comprising:

an upper coupled to a sole having a top surface attached to the upper and a bottom surface disposed opposite of the top surface, the bottom surface being configured to contact a ground surface, the top surface and the bottom surface of the sole extending continuously along a length of the article of footwear from a heel region to a forefoot region;

wherein an outermost wall of the upper is coupled to the top surface of the sole along a center portion of the sole extending along a longitudinal direction between the heel region and the forefoot region;

wherein the outermost wall of the upper is coupled to the top surface of the sole along a periphery of the sole in both the forefoot region and the heel region; and wherein, through a midfoot region, the outermost wall of the upper is further coupled to the top surface of the sole at an attachment boundary position spaced from the periphery of the sole along the lateral direction; and wherein, through the midfoot region, spacing the attachment boundary position from the periphery of the sole allows a rolling portion of the outermost wall of the upper to move between a first position in which at least a portion of the rolling portion extends generally vertically away from the top surface of the sole thereby exposing a visible portion of the top surface of the sole, and a second position in which the at least a portion of the rolling portion extends generally horizontally and covers at least a portion of the top surface of the sole between the attachment boundary position and the periphery such that the visible portion of the top surface of the sole is reduced.

19. The article of footwear according to claim 18, wherein, throughout the midfoot region, the attachment boundary position is at least 10% of a width of the sole in the lateral direction away from the periphery of the sole.

20. The article of footwear according to claim 19, wherein, through the midfoot region, the outermost wall of the upper is coupled to the top surface of the sole at an attachment boundary position spaced from the periphery of the sole on each of a lateral side and a medial side of the sole.

21. The article of footwear according to claim 20, wherein, throughout the midfoot region, the attachment boundary position on each of the lateral side and the medial side of the sole is at least 10% of the width of the sole in the lateral direction away from the periphery of the sole.

22. The article of footwear according to claim 20, wherein the outermost wall of the upper and the sole are coupled asymmetrically on the medial side and the lateral side across the lateral direction.

23. The article of footwear according to claim 20, further comprising a first impact absorber attached to the rolling portion of the outermost wall of the upper on a medial side of the upper and a second impact absorber attached to the rolling portion of the outermost wall of the upper on a lateral side of the upper.

24. The article of footwear according to claim 23, wherein the first impact absorber is attached to an exterior surface of the rolling portion on the medial side of the upper and the second impact absorber is attached to an exterior surface of the rolling portion on the lateral side of the upper;

wherein, in their respective second positions, the first impact absorber and the second impact absorber contact the top surface of the sole; and wherein, in their respective first positions, the first impact absorber and the second impact absorber are spaced away from the sole so as to expose the top surface of the sole.

25. The article of footwear according to claim 18, wherein the outermost wall of the upper and the sole are coupled asymmetrically on a medial side and a lateral side across the lateral direction.

26. The article of footwear according to claim 18, further comprising an impact absorber attached to an exterior surface of the rolling portion of the outermost wall of the upper.

27. The article of footwear according to claim 26, wherein the impact absorber is attached to the exterior surface of the rolling portion of the outermost wall of the upper throughout the midfoot region of the upper;

wherein, in the first position, the impact absorber is spaced apart from the top surface of the sole along a vertical direction thereby exposing a visible area of the impact absorber; and wherein, in the second position, the impact absorber contacts the at least a portion of the top surface of the sole such that the visible area of the impact absorber is reduced.

28. The article of footwear according to claim 18, wherein the outermost wall of the upper is attached to a peripheral edge of the top surface of the sole along a lateral side and a medial side of the forefoot region and the heel region.

* * * * *